United States Patent [19]

Young

[11] Patent Number: 4,576,334

[45] Date of Patent: Mar. 18, 1986

[54] CAST SHOULDER

[75] Inventor: Hartley F. Young, West Melton, Australia

[73] Assignee: Ralph McKay Limited, Maidstone, Australia

[21] Appl. No.: 604,182

[22] Filed: Apr. 26, 1984

[30] Foreign Application Priority Data

Apr. 29, 1983 [AU] Australia ..... PF9119

[51] Int. Cl.[4] ..... E01B 9/30

[52] U.S. Cl. ..... 238/310; 238/349

[58] Field of Search ..... 238/310, 338, 349, 351

[56] References Cited

U.S. PATENT DOCUMENTS 4,053,107 10/1977 Goderbauer ..... 238/349

FOREIGN PATENT DOCUMENTS 518672 6/1978 Australia .

47728 6/1979 Australia .

76330 10/1981 Australia .

46207 10/1962 Poland ..... 238/349

*Primary Examiner*—Harry Tanner

*Attorney, Agent, or Firm*—Christel, Bean & Linihan

[57] ABSTRACT

A support for an elastic rail clamp comprising two legs which are adapted to the above the rail tie surface adjacent the rail flange. The rail clamp is oriented at right angles to the longitudinal dimension of the rail and has two free arms which lie on the rail flange. To prevent accidental removal of the rail clamp from the support the support includes in the face adjacent the rail flange a channel for each arm to pass through when moving onto or off the rail flange. This provides a raised portion of the support between the two arms of the clamp. The support is also designed to ensure that contact points between the rail clamp and the support are minimal to reduce the incidence of corrosion bonding.

5 Claims, 7 Drawing Figures

CAST SHOULDER

This invention relates to rail fastening systems and in particular to a support for an elastic rail clamp.

The applicants earlier Australian Pat. No. 518672 disclosed a cast support having an inclined surface to assist the raising of that portion of the elastic rail clip which lies on the rail flange. Conventionally rail ties are mostly formed from concrete and the rail clip supports are moulded into the cast concrete ties. A number of proposals have been made for the construction of these supports and include Australian patent applications Nos. 76330/81 (Pandrol) and 47728/79 (Everts).

In particular this invention is concerned with a fastener of the kind which is applied at right angles to the rail flange and has one portion lying on the rail flange exerting a hold down force and a second portion secured in the support which in turn is embedded in the rail tie. A problem associated with rail clips of this kind is that vibration of the rail tends to move the rail clip laterally off the rail flange. With rail clips of the kind described in U.S. Pat. Nos. 4,313,563 (Young), 3,067,947 (Deenik) and 3,881,653 (Jacobsen) where two resilient arms are part of the clip the support is usually designed to provide two abutting shoulders and an intermediate gap adjacent the rail flange to prevent withdrawal of the clip unless the arms are compressed together.

A difficulty arises with fastenings of this type when the elastic clip is struck in a particular position. Such impacts can occur during normal railway track maintenance operations such as ballast tamping. If a lateral clip is struck in such a manner that one arm is compressed and the clip as a whole is slewed so that the second arm no longer abuts a shoulder of the clip support, then both arms are free to pass between the shoulders of the clip support. In such circumstances the clip is likely to slide off the rail flange and be dislocated.

It is an object of this invention to provide a rail clip support which is able to prevent accidental dislocation of the rail clip.

To this end the present invention provides a support for an elastic rail clip comprising a first portion adapted to secure said support to a rail tie and a second portion adapted to receive and hold a base portion of a rail clip of the kind having two free arms which lie on the rail flange, said second portion of said support comprising a recess laterally disposed to said rail flange and having an entry remote from said rail flange, said recess being adapted to received said base portion of a rail clip and includes a face adjacent said rail flange which incorporates a channel for each free arm of said elastic clip to pass through when moving onto or off said rail flange. Thus in addition to the two shoulders of the support a raised central portion is provided which lies between the free arms of the clip and prevents any withdrawal of the clip when the clip is not at right angles to the rail. Thus if the clip is knocked from the side and is no longer at right angles to the rail, it will not move off the rail flange.

Another difficulty encountered with rail clips and their conventional supports is corrosion of these metal components. Corrosion bonding is the usual result of the exposure to moisture of the rail tie. This bonding occurs where there is metal to metal contact between the rail clip and the support. This problem has not been solved by the conventional supports and fracture of rail clips and supports can occur during attempts to replace rail clips. Such fracture can be costly in terms of time and money because it may require replacement of the rail tie.

It is a further object of this invention to minimize the deleterious effects of corrosion.

To this end the present invention provides a support for an elastic rail clip comprising a first portion adapted to secure said support to a rail tie and a second portion adapted to receive and hold a portion of a rail clip wherein the second portion includes a recess for receiving said rail clip, said recess having upper and lower contact surfaces wherein these surfaces are so shaped to allow only small areas of the rail clips and support to be in contact or close enough to allow corrosion bonding to occur.

The base of the rail clip held by the support needs to contact the upper and lower surfaces of the recess only in two small areas to effectively hold the rail clip in place. Any corrosion build-up at these points will only comprise a small area and fracture of such bonding will not require excessive force.

A preferred embodiment incorporating both the above referenced improvements will now be described.

In the drawings,

FIG. 1 is a front view of the support;

FIG. 2 a perspective view;

FIG. 3 is a plan view;

FIG. 4 an underneath view;

FIG. 5 a view from the rear;

Figure 1:
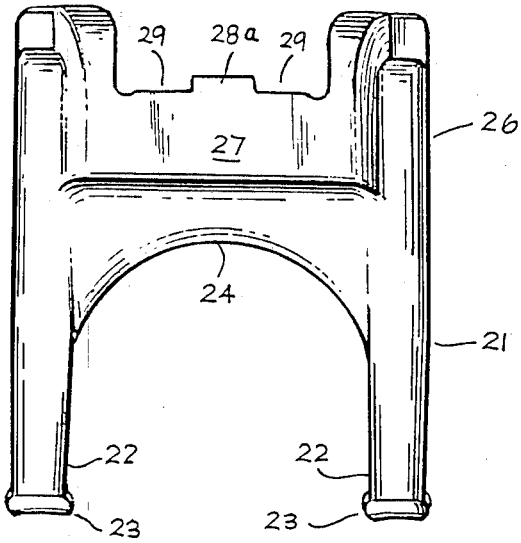
Figure 2:
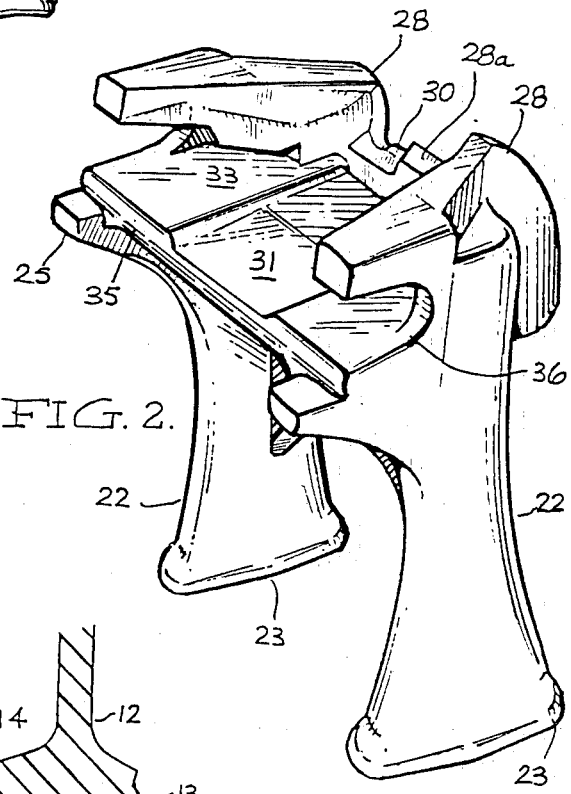
Figure 7:
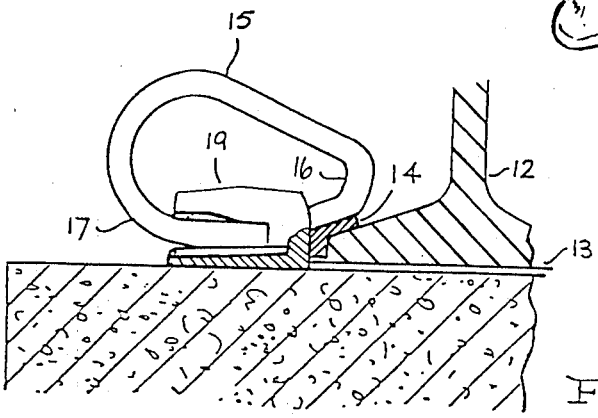
FIG. 7 is a sectional view showing the support embedded in a concrete tie with a rail clip in position.
Figure 3:
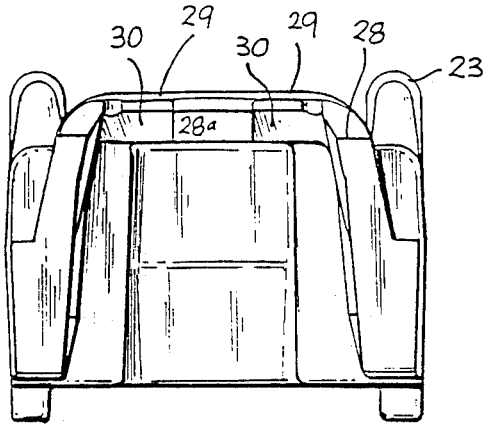
Figure 4:
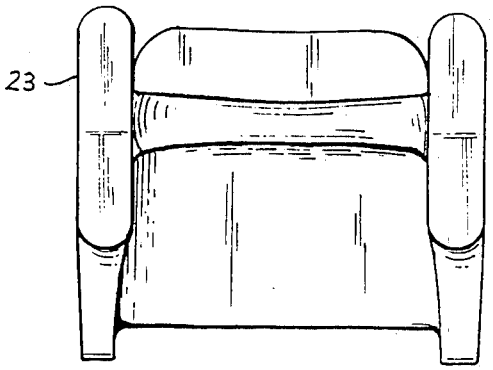
Figure 5:
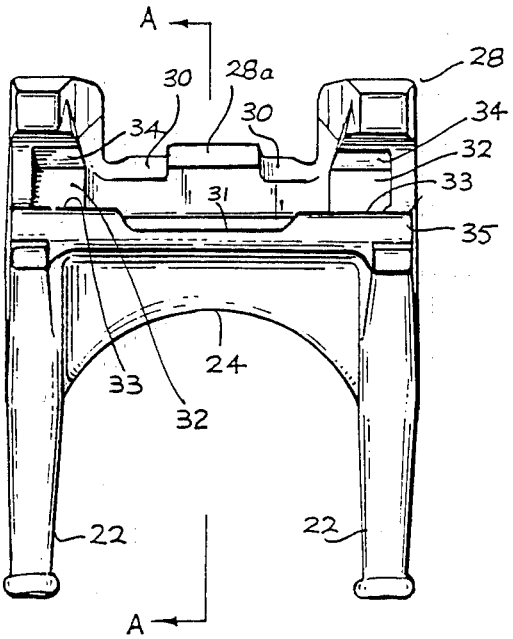
Figure 6:
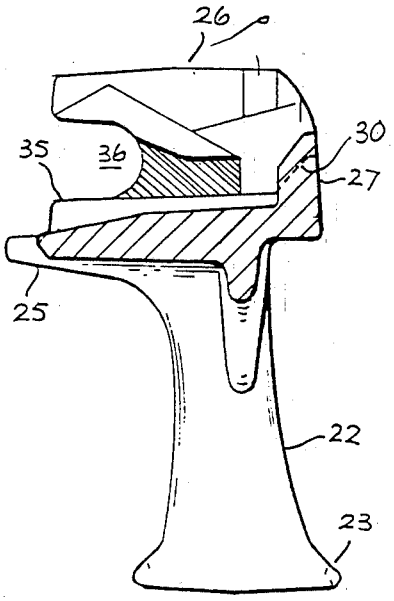
FIG. 6 is a sectional view along A—A of FIG. 5.

As seen in FIG. 7, the rail seat comprises a rail tie 11, a rail 12, a tie insulator 13, a rail insulator 14, a rail clip 15 comprising a portion 16 consisting of two free arms which bears on the rail flange and a portion 17 which seats within the clip support 19. The rail clip is preferably of the kind described in U.S. Pat. No. 4,313,563.

The support 19, formed from cast iron, comprises the tie securing section 21 and the clip receiving portion 26. The section 21 which is embedded in the concrete tie 11 comprises a pair of legs 22 having extended feet 23 and which are joined by web 24. The feet 23 resist any tendency for the support to be pulled out of the tie. Web 24 with the provision of the two legs ensures that the support will not twist or skew within the tie. The support is embedded in the tie up to the ribs 25.

When positioned in the tie the face 27 lies adjacent the rail and is shaped to fit within the insulator 14. From the front the support is seen to have two shoulders 28 and between them a gate 29 through which passes the portion of the arms of the rail clip which lies on the rail flange. This gate 29 is divided into two sections by the upstanding central flange 28*a*. The horizontal edge of the gates 29 include a ramp 30 which assists in raising this portion of the rail clip. In the rail seat the edge of the horizontal gates 29 lie above the rail flange. Each arm of rail clip portion 16 passes through one of the respective gates 29 and when in position abuts the outer face of a shoulder 28 which abutment prevents withdrawal of the clip 15.

The receiving portion of the support comprises a base 31, support slots 32 on either side of the support located behind shoulders 28 on each slot 32 being defined by a lower contact surface 33 and an upper contact surface 34.

These two surfaces are so shaped that the area of contact between the rail clip and these surfaces 33 and 34 is insufficient for corrosion bonding to occur to a degree which would impede removal of the rail clip. Preferably the base 31 has a slight slope to enable drainage to occur which will also decrease the possibility of corrosion occurring. The dimples or sloping projections 35 may be moulded as shown.

The recess 36 in the sides of the clip receiving portion 26 are used in correctly locating the support in the rail tie casting mould. A rod on the base of the mould locates the support to the correct depth in the mould so that in the finished tie the four supports all project the same height above the tie surface.

From the above description it can be seen that the present invention provides a cast support that minimizes the problem of accidental dislocation of the rail clip.

The claims defining the invention are as follows; I claim:

1. A support for an elastic rail clip comprising a first portion adapted to secure said support to a rail tie and a second portion adapted to receive and hold a base portion of a rail clip of the kind having two free arms which lie on the rail flange, said second portion of said support comprising a recess laterally disposed to said rail flange and having an entry remote from said rail flange, said recess being adapted to receive said base portion of a rail clip and includeing a face adjacent said rail flange which incorporates a channel for each free arm of said elastic clip to pass through when moving onto or off said rail flange, said channels being separated by an upstanding portion on said face which prevents accidental ejection of said rail clip.

2. A support as claimed in claim 1 wherein said channels are located above the base of said recess and a ramp is incorporated in the base of said channels.

3. A support as claimed in claim 1 or claim 2 wherein said recess has upper and lower contact surfaces abutted by said base portion of said clip and said contact surfaces are so shaped to allow only minimal areas of the clip base and said contact surfaces to be in contact.

4. A support as claimed in claim 3 wherein said recess incorporates slots which surround the edges of the clip base which are laterally disposed to said rail said slots providing an upper contact surface for the inner end of said lateral edge of said clip base and a lower contact surface located toward the entry to said recess.

5. A support as claimed in claim 1 formed from cast iron.

* * * * *